US006781310B2

(12) United States Patent
Kwon

(10) Patent No.: US 6,781,310 B2
(45) Date of Patent: Aug. 24, 2004

(54) PLASMA DISPLAY PANEL

(75) Inventor: Tae In Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 155 days.

(21) Appl. No.: 10/226,537

(22) Filed: Aug. 23, 2002

(65) Prior Publication Data

US 2003/0122487 A1 Jul. 3, 2003

(30) Foreign Application Priority Data

Dec. 27, 2001 (KR) ..... 2001-86116

(51) Int. Cl.[7] ..... H01J 17/49
(52) U.S. Cl. ..... 313/587; 313/112; 313/117
(58) Field of Search ..... 313/587, 112, 313/117, 586; 345/37, 41, 60

(56) References Cited

U.S. PATENT DOCUMENTS 5,838,106 A * 11/1998 Funada ..... 313/587
6,242,859 B1 * 6/2001 Betsui et al. ..... 313/584
6,344,080 B1 * 2/2002 Kim et al. ..... 106/287.23
6,429,587 B1 * 8/2002 Sugimachi et al. ..... 313/582
6,559,592 B1 * 5/2003 Lee ..... 313/495
6,630,789 B2 * 10/2003 Hirota et al. ..... 313/582

* cited by examiner

*Primary Examiner*—Ashok Patel
(74) *Attorney, Agent, or Firm*—Lee Hong Degerman Kang & Schmadeka

(57) ABSTRACT

In a plasma display panel which is capable of improving colorimetric purity without lowering light efficiency by selectively filtering only visible light of request color, a plasma display panel includes a filter including a grating layer having plural gratings for diffracting lights generated in a plasma display panel at a certain angle and a black matrix layer for transmitting or cutting off the lights diffracted by the grating layer.

17 Claims, 2 Drawing Sheets

PLASMA DISPLAY PANEL

BACKGROUND OF THE INVENTION

1. Field of the Invention

The present invention relates to a plasma display panel, and in particular to a plasma display panel which is capable of improving colorimetric purity by selectively filtering and outputting only visible light of request color.

2. Description of the Prior Art

In general, a plasma display panel is for displaying images by using visible light generated from a fluorescent layer after exciting the fluorescent layer with ultraviolet light of plasma.

In the meantime, in the conventional plasma display panel, by near infrared light or visible light generated from discharge gas and outer visible light irradiated from the outside and reflected, a contrast may be lowered. Accordingly, in order to improve the contrast, a color filter is mounted onto the plasma display panel.

When the color filter is mounted onto the plasma display panel, because fabrication process is complicated, yield rate is lowered, and accordingly a production cost is increased. Hereinafter, a structure of the conventional plasma display panel will be described with reference to accompanying FIG. 1.

FIG. 1 is a sectional view illustrating a structure of a plasma display panel using a color filter in accordance with the conventional art.

As depicted in FIG. 1, the conventional plasma display panel includes an insulating layer 9 formed onto a lower glass substrate 10; an address electrode 11 formed at a certain portion of the insulating layer 9; a lower dielectric layer 8 formed onto the front surface of the address electrode 11 and the insulating layer 9; a barrier rib 7 defined at a certain portion of the lower dielectric layer 8 to divide each discharging cell; a black matrix layer 12 formed onto the barrier rib 7; a fluorescent layer 13 formed at the side surface of the first black matrix layer 12 and the barrier rib 7 and the front surface of the lower dielectric layer 8 so as to have a certain thickness in order to emit each red, green and blue visible light by receiving ultraviolet light; an upper glass substrate 2; a sustain electrode 3 formed at a certain portion of the upper glass substrate 2 so as to cross the address electrode 11 vertically; a bus electrode 5 formed at a certain portion of the sustain electrode 3; an upper dielectric layer 4 formed at the front surface of the bus electrode 5, the sustain electrode 3 and the upper glass substrate 2; a protecting layer 6 formed onto the upper dielectric layer 4 to protect the upper dielectric layer 4; and a color filter 1 installed at the upper front surface of the upper glass substrate 2, filtering colors displayed by each pixel and transmitting the filtered colors. Hereinafter, the operation of the conventional plasma display panel will be described.

First, in the conventional plasma display panel, by potential difference between the address electrode 11 and the bus electrode 5, discharge gas within a pixel region defined by the barrier rib 7 is in a plasma state, the fluorescent layer 13 is excited by ultraviolet light of the plasma, visible light is generated by the excitation of the fluorescent layer 13, and an image is displayed by using the visible light. In more detail, by exciting the fluorescent layer 13 by using ultraviolet light generated by Xe gas among discharge gases such as He gas, Xe gas, Ne gas, etc. filled in the discharge space defined by the barrier rib 7, an expected color can be displayed.

In addition, the Ne gas is filled in the discharge space in order to prevent thermal deformation phenomenon of the dielectric layer 4 or the fluorescent layer 13 occurred by collision of accelerated gas ions.

However, because the Ne gas emits orange color visible light, it lowers colorimetric purity and contrast of the plasma display panel. Accordingly, in the conventional plasma display panel, the color filter 1 is installed in order to prevent orange color visible light emitted by the Ne gas discharge. Herein, the color filter 1 only filters color of each pixel and consists of color layers 1A~1C for transmitting the filtered color and a cutting layer 1D formed between the color layers and cutting off light.

When the color filter 1 is applied to the plasma display panel, reflection rate of visible light irradiated from the outside of the plasma display panel can be improved, and accordingly contrast of the plasma display panel can be improved.

However, in application of the color filter 1 to the plasma display panel, fabrication process is complicated, yield rate is lowered, and accordingly a production cost is increased.

In the meantime, other conventional plasma display panels and fabrication methods thereof are disclosed in U.S. Pat. No. 5,838,106 (Nov. 17, 1998), in U.S. Pat. No. 6,242,859 (May 6, 2001) and in U.S. Pat. No. 6,344,080 (Feb. 5, 2002).

As described above, in the conventional plasma display panel, in use of the color filter 1, contrast can be improved, however, fabrication process is complicated, yield rate is lowered, and accordingly a production cost is increased.

In addition, in the conventional plasma display panel, the color filter 1 may lower light efficiency of the plasma display panel by light transmittivity of the color layer thereof.

SUMMARY OF THE INVENTION

In order to solve the above-mentioned problem, it is an object of the present invention to provide a plasma display panel which is capable of improving colorimetric purity without lowering light efficiency by selectively filtering only visible light of request color.

In order to achieve the above-mentioned object, a filter of a plasma display panel includes a grating layer having plural gratings for diffracting lights generated in a plasma display panel at a certain angle and a black matrix layer for transmitting or cutting off the lights diffracted by the grating layer.

In order to achieve the above-mentioned object, in a plasma display panel including an upper glass substrate, a first electrode, an upper transparent dielectric layer and a protecting layer sequentially formed onto the upper glass substrate, a lower glass substrate formed with a certain distance from the upper glass substrate, a second electrode, a lower transparent dielectric layer, an barrier rib and a fluorescent layer sequentially formed onto the lower glass substrate, a plasma display panel further includes a filter consisting of a grating layer having plural gratings for diffracting lights generated in a plasma display panel at a certain angle and a black matrix layer transmitting or cutting off the lights diffracted by the grating layer.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiments of a plasma display panel in accordance with the present invention will be described in detail with reference to accompanying FIGS. 2~4. Without using a color filter and lowering light efficiency, a plasma display panel in accordance with the present invention is capable of improving colorimetric purity by using a filter consisting of a grating layer having plural gratings for diffracting light generated in a plasma display panel at a certain angle and a black matrix layer for transmitting or cutting off the light diffracted by the grating layer.

Figure 2:
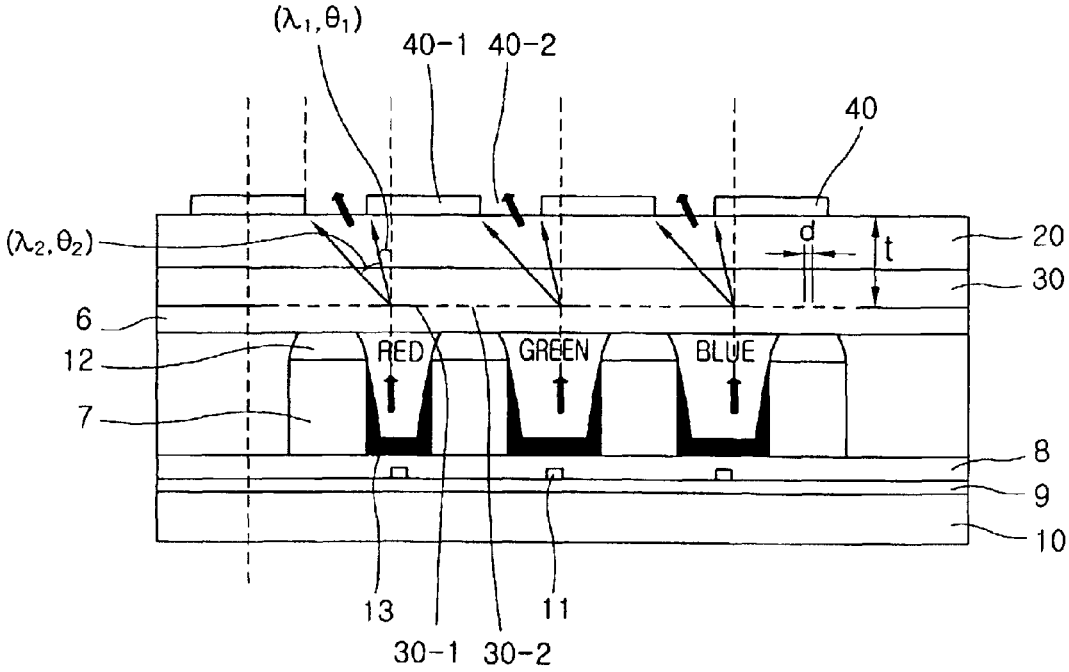
FIG. 2 is a sectional view illustrating a plasma display panel in accordance with the present invention.

FIG. 2 is a sectional view illustrating a plasma display panel in accordance with the present invention.

Figure 1:
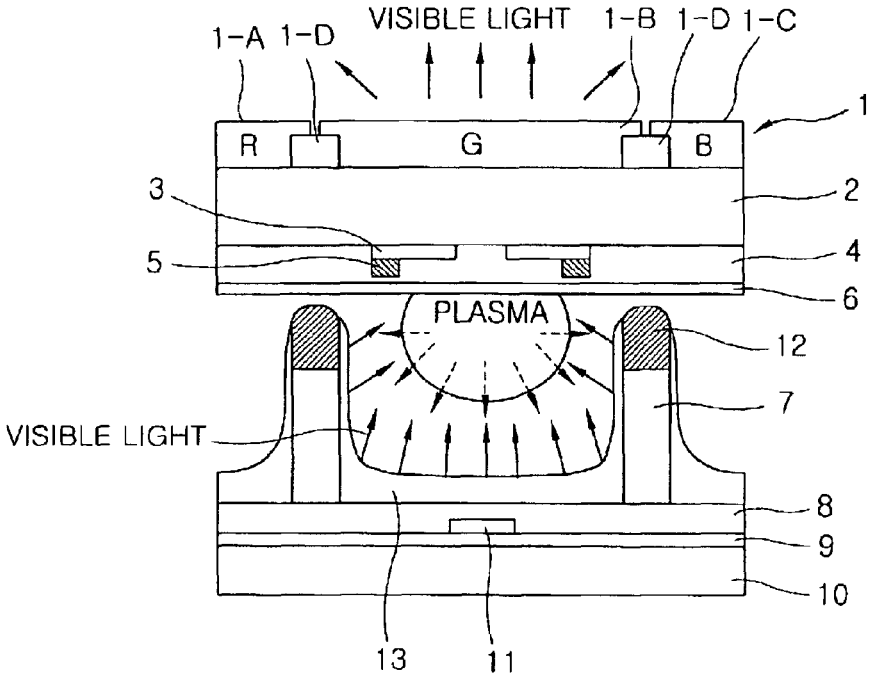
FIG. 1 CONVENTIONAL ART
FIG. 1 is a sectional view illustrating a structure of a plasma display panel using a color filter in accordance with the conventional art.

As depicted in FIG. 2, the plasma display panel includes an insulating layer 9 formed onto a lower glass substrate 10; an address electrode 11 formed at a certain portion of the insulating layer 9; a lower dielectric layer 8 formed onto the front surface of the address electrode 11 and the insulating layer 9; a barrier rib 7 defined at a certain portion of the lower dielectric layer 8 to divide each discharging cell; a black matrix layer 12 formed onto the barrier rib 7; a fluorescent layer 13 formed at the side surface of the first black matrix layer 12 and the barrier rib 7 and the front surface of the lower dielectric layer 8 so as to have a certain thickness in order to emit each red, green and blue visible light when ultraviolet light is applied; an upper glass substrate (not shown, the same as the reference numeral 2 in FIG. 1) installed onto the barrier rib 7 so as to be parallel to the lower glass substrate 10 with a certain interval; a sustain electrode (not shown, the same as the reference numeral 3 in FIG. 1) formed at a certain portion of the upper glass substrate so as to cross the address electrode 11 vertically; a bus electrode (not shown, the same as the reference numeral 5 in FIG. 1) formed at a certain portion of the sustain electrode; an upper dielectric layer 20 formed at the front surface of the bus electrode, the sustain electrode and the upper glass substrate; and a protecting layer 6 formed onto the upper dielectric layer 20 to protect the upper dielectric layer 20.

Herein, a filter of the plasma display panel in accordance with a first embodiment of the present invention consists of a grating layer 30 which includes a metal layer 30-1 having plural gratings 30-2 mounted onto the lower surface of the upper dielectric layer 20 so as to correspond to a pixel region defined by the barrier rib 7 and diffracting light generated in the plasma display panel at a certain angle; and a second black matrix layer 40 mounted onto the upper surface of the upper dielectric layer 20 so as to go amiss the pixel region defined by the barrier rib 7 with a certain interval and transmitting or cutting off the light diffracted by the grating layer 30. The second black matrix layer 40 is a metal layer 40-1 having plural apertures 40-2. In addition, the grating layer 30 can be constructed as a protecting layer having a grating structure formed onto the lower surface of the upper dielectric layer 20 and diffracting light with different interval according to a wavelength of light.

Hereinafter, the grating layer 30 of the filter will be described in detail with reference to accompanying FIG. 3.

Figure 3:
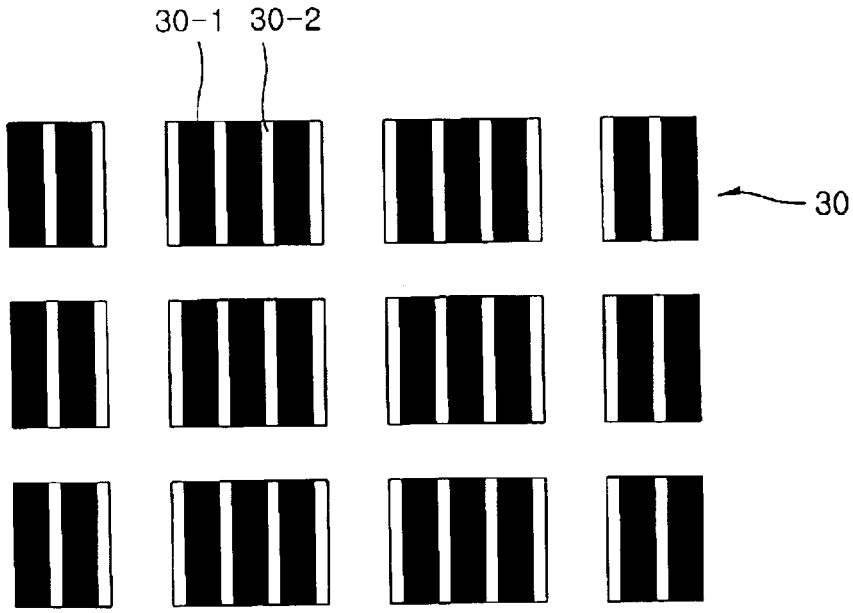
FIG. 3 is a plan view illustrating a grating layer of a filter of a plasma display panel in accordance with a first embodiment of the present invention.

FIG. 3 is a plan view illustrating the grating layer of the filter of the plasma display panel in accordance with the first embodiment of the present invention.

As depicted in FIG. 3, the grating layer 30 of the filter of the plasma display panel is the metal layer 30-1 having the grating structure 30-2. In more detail, the metal layer 30-1 of the grating layer 30 cuts off light placed at the upper portion of the barrier rib 7 and the first black matrix layer 12. In addition, the metal layer 30-1 has the grating structure 30-2 at a region corresponded to the pixel. In more detail, a diffraction angle is differentiated according to a frequency of light transmitting the grating structure 30-2, and spectrum of light can be obtained according to the diffraction angle.

Afterward, the second black matrix layer 40 formed onto the upper portion of the upper dielectric layer 20 filters light transmitted from the grating layer 30 to extract visible light of request color from the spectrum.

Hereinafter, the operation of the plasma display panel in accordance with the present invention will be described in detail.

First, when voltage is applied to the sustain electrode 3, the bus electrode 5 and the address electrode 11, discharge gas in the pixel region defined by the barrier rib 7 is in a plasma state, by ultraviolet light generated in the plasma, red, green or blue color visible lights are generated. Herein, by the Ne gas in the reaction gases, orange color visible light is generated, and near infrared light is generated in the plasma.

Afterward, the visible light generated in the fluorescent layer 15 is transmitted transmits the protecting layer 6 and diffracts through the grating layer 30 having the grating structure. In more detail, the unnecessary visible light and near infrared light are cut off by the grating layer 30 and the second black matrix layer 40.

Cutting off the orange color visible light and near infrared light by the grating layer 30 and the second black matrix layer 40 will be described in more detail.

First, an interval of the gratings of the grating layer 30 is differentiated according to color (red, green, blue) of each pixel. In more detail, the interval of the gratings can be calculated by following Equation 1.

$$d \sin \theta = m\lambda \qquad \text{Equation 1}$$

Herein, d is an interval of ratings, $\lambda$ is a wavelength of visible light generated at a pixel, $\theta$ is a diffraction angle of the light transmitting the grating layer 30, and m is integer.

As shown in Equation 1, it is possible to diffract a wavelength of request (preset) visible light at a certain angle according to an interval of the gratings. In more detail, according to variation of the integer m, interference fringe of unnecessary light occurs onto the second black matrix layer 40, only request wavelength visible light can be filtered through the aperture 40-2 of the second black matrix layer 40.

For example, when a wavelength of visible light to be transmitted is in the range of $\lambda 1 \sim \lambda 2$, an interval of the gratings of the grating layer 30 is d, a distance between the grating layer 30 and the second black matrix layer 40 is t (a certain interval), and interference fringe having the integer m as 1 is used, a position of the aperture 40-2 of the second black matrix layer 40 is calculated as below.

First, in the $\lambda 1$ wavelength, a diffraction angle $\theta 1$ is $\sin^{-1}(\lambda 1/d)$, in the $\lambda 2$ wavelength, a diffraction angle $\theta 2$ is $\sin^{-1}(\lambda 2/d)$. In more detail, an angle of light to be transmitted is in the range of the diffraction angle $\theta 1 \sim \theta 2$. Accordingly, the aperture 40-2 of the second black matrix layer 40 is formed at a certain interval (t) between light diffracted by the grating layer 30 and a portion receiving light having a request angle (preset angle; angle of light having a diffraction angle in the range of $\theta 1 \sim \theta 2$). Another visible light out of the $\theta 1 \sim \theta 2$ ranges is absorbed to the metal layer 40-1 of the second black matrix layer 40, and accordingly it can not be transmitted. In more detail, the aperture 40-2 of the black matrix layer 40 is placed on a region at which light (having a diffraction angle in $\theta 1 \sim \theta 2$ ranges) diffracted by transmitting the grating structure 30-2 of the grating layer 30 is transmitted, and the metal layer 40-1 of the black matrix layer 40 is placed at a region out of the light transmitting region. Herein, in order to transmit selectively light having the preset angle (diffraction angle in $\theta 1 \sim \theta 2$ ranges) among the diffracted lights, a position of the aperture 40-2 of the black matrix layer 40 is determined according to a distance between the black matrix layer 40 and the grating layer 30.

In addition, the farther a distance between the grating layer 30 and the second black matrix layer 40, the more interference fringe generated by the grating layer 30 is distinct. In more detail, the farther the distance, the more easily filtering can be performed.

In the meantime, the grating layer 30 having the grating structure can be mounted onto the upper dielectric layer (upper transparent dielectric layer) 20 or a boundary region between the upper dielectric layer 20 and the protecting layer 6 or the protecting layer 6.

In addition, it is possible to form the grating structure 30-2 of the grating layer 30 not onto the upper surface of the upper dielectric layer 20 but onto the lower surface of the upper dielectric layer 20 or the protecting layer 6 by scratching the portion by diamond point. In addition, it is possible to form the grating structure 30-2 by grooving the lower surface of the upper dielectric layer 20 or the protecting layer 6 with laser.

In addition, after forming the second black matrix layer 40 with a certain interval (t) from the upper portion of the grating layer 30, the formed filter can be installed at the upper or lower surface of the upper dielectric layer 20 and the upper or lower surface of the upper glass substrate 2. In more detail, the grating layer 30 having the grating structure 30-2 is installed at a portion lower than the second black matrix layer 40.

Figure 4:
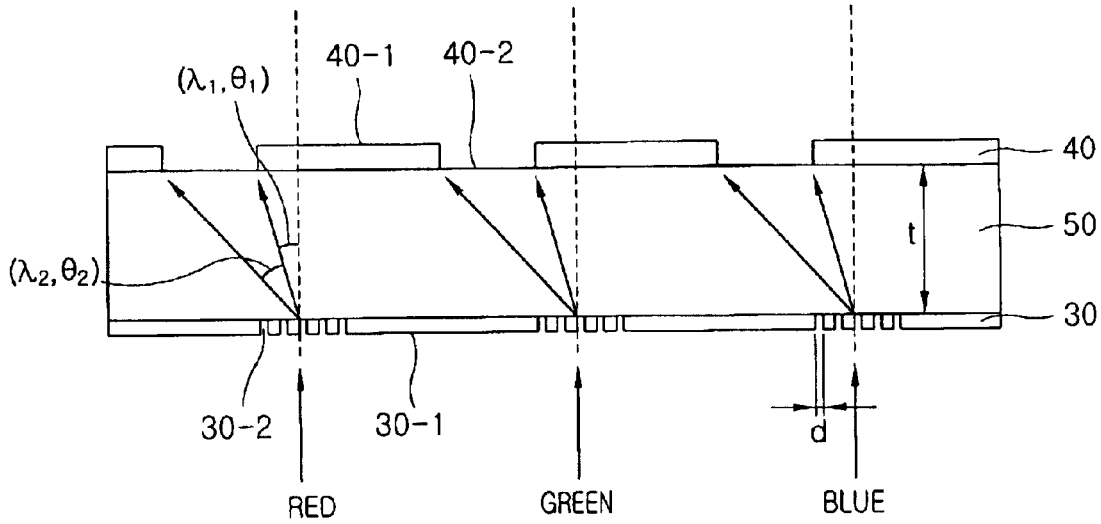
FIG. 4 is a sectional view illustrating a filter of a plasma display panel in accordance with a second embodiment of the present invention.

FIG. 4 is a sectional view illustrating a filter of a plasma display panel in accordance with a second embodiment of the present invention.

As depicted in FIG. 4, the filter of the plasma display panel consists of the second black matrix layer 40 including the metal layer 40-1 having plural apertures 40-2 formed at the upper surface of the glass substrate 50; and the grating layer 30 having the grating structure formed at the lower surface of the glass substrate 50. Herein, the filter of the plasma display panel in accordance with the second embodiment of the present invention is mounted onto the surface of the upper glass substrate 2, and accordingly a colorimetric purity can be improved without lowering light efficiency same as the first embodiment.

The grating layer 30 having the grating structure can be formed by forming gratings onto a high-polymer film such as a PET (polyethylene terephthalate) layer and inserting the film into a request position or adhering the high-polymer film onto a request surface by laminating thereof. The second black matrix layer 40 can be formed by depositing metal onto the upper portion of a request thin layer and patterning the deposited metal by using a photo-engraving process.

In the meantime, the filter of the plasma display panel in accordance with the second embodiment of the present invention can be installed at the front surface of the plasma display panel.

As described above, by diffracting visible light generated in a fluorescent layer by transmitting it through a grating layer having a minute grating structure, and selectively transmitting only visible light in a request (preset) wavelength region among the visible light diffracted through the black matrix layer, it is possible to cut off orange color visible light and near infrared light generated in reaction gas.

In addition, by diffracting visible light generated in the fluorescent layer by transmitting it through the grating layer having the minute grating structure, and selectively transmitting only visible light in a request (preset) wavelength region among visible lights diffracted through the black matrix layer, it is possible to prevent light efficiency lowering of a plasma display panel.

In addition, by diffracting visible light generated in the fluorescent layer by transmitting it through the grating layer having the minute grating structure, and selectively transmitting only visible light in a request (preset) wavelength region among visible lights diffracted through the black matrix layer, it is possible to improve colorimetric purity of a plasma display panel with a low production cost.

In addition, by diffracting visible light generated in the fluorescent layer by transmitting it through the grating layer having the minute grating structure, and selectively transmitting only visible light in a request (preset) wavelength region among visible lights diffracted through the black matrix layer, it is possible to prevent wrong operation of an infrared remote controller.

What is claimed is:

1. A plasma display panel, comprising:

a filter including a grating layer having plural gratings for diffracting lights generated in a plasma display panel at a certain angle and a black matrix layer for transmitting or cutting off the lights diffracted by the grating layer.

2. The panel of claim 1, wherein an interval of the gratings is calculated by using $d \sin \theta = m\lambda$, herein, d is an interval of gratings, $\lambda$ is a wavelength of visible light generated at a pixel, $\theta$ is a diffraction angle of light transmitting the grating layer having the grating structure, and m is integer.

3. The panel of claim 2, wherein a position of an aperture of the black matrix layer is determined according to a distance between the black matrix layer and the grating layer in order to transmit selectively light having a preset angle among the diffracted lights.

4. The panel of claim 1, wherein the grating layer and the black matrix layer are respectively formed at the front or the rear of a glass substrate and adhered to the front surface of the plasma display panel.

5. The panel of claim 4, wherein the grating layer is formed by forming gratings onto a high-polymer film, adhering the film to the front surface of the glass substrate or coating the grating-formed high polymer film onto the front surface of the glass substrate.

6. The panel of claim 1, wherein the filter is formed onto an upper glass substrate of the plasma display panel.

7. The panel of claim 6, wherein the filter includes:

the black matrix layer formed onto the upper glass substrate;

a transparent dielectric layer formed onto the black matrix layer;

the grating layer formed onto the transparent dielectric layer and diffracting the lights with a different interval according to a wavelength of lights to be filtered; and a protecting layer formed onto the grating layer.

8. The panel of claim 6, wherein the filter includes:

the black matrix layer formed onto the upper glass substrate;

a transparent dielectric layer formed onto the black matrix layer; and a protecting layer having a grating structure formed onto the transparent dielectric layer and diffracting the lights with a different interval according to a wavelength of lights to be filtered.

9. In a plasma display panel including an upper glass substrate, a first electrode, an upper transparent dielectric layer and a protecting layer sequentially formed onto the upper glass substrate, a lower glass substrate formed with a certain distance from the upper glass substrate, a second electrode, a lower transparent dielectric layer, an barrier rib and a fluorescent layer sequentially formed onto the lower glass substrate, a plasma display panel, further comprising:

a filter including a grating layer having plural gratings for diffracting lights generated in a plasma display panel at a certain angle and a black matrix layer transmitting or cutting off the lights diffracted by the grating layer.

10. The panel of claim 9, wherein an interval of the gratings is calculated by using $d \sin \theta = m\lambda$, herein, d is an interval of ratings, $\lambda$ is a wavelength of visible light generated at a pixel, $\theta$ is a diffraction angle of light transmitting the filter layer having the grating structure, and m is integer.

11. The panel of claim 10, wherein the black matrix layer includes plural apertures, and the apertures are formed at a portion in which light having a preset angle among the diffracted lights is transmitted.

12. The panel of claim 9, wherein the grating layer and the black matrix layer are respectively formed at the front or the rear of a glass substrate and adhered to the front surface of the plasma display panel.

13. The panel of claim 9, wherein the grating layer is formed by forming gratings onto a high polymer film, adhering the grating-formed high polymer film to the front surface of the upper glass substrate or coating the grating-formed high polymer film onto the front surface of the upper glass substrate.

14. The panel of claim 9, wherein the filter is formed onto the upper glass substrate.

15. The panel of claim 9, wherein the black matrix layer is formed onto the upper glass substrate, the upper transparent dielectric layer is formed onto the black matrix layer, the grating layer for diffracting lights with a different interval according to a wavelength of lights is formed onto the upper transparent dielectric layer, and the protecting layer is formed onto the grating layer.

16. The panel of claim 9, wherein the filter includes:

the black matrix layer formed onto the upper glass substrate;

the transparent dielectric layer formed onto the black matrix layer; and a protecting layer having a grating structure formed onto the transparent dielectric layer and diffracting lights with a different interval according to a wavelength of lights to be filtered.

17. The panel of claim 9, wherein the grating layer is formed onto the upper transparent dielectric layer or between the upper transparent dielectric layer and the protecting layer or onto the lower surface of the protecting layer, and the black matrix layer is formed onto the upper portion of the grating layer.

* * * * *